US007171007B2

(12) United States Patent
Rajan

(10) Patent No.: US 7,171,007 B2
(45) Date of Patent: Jan. 30, 2007

(54) SIGNAL PROCESSING SYSTEM

(75) Inventor: Jebu Jacob Rajan, Bracknell (GB)

(73) Assignee: Canon Kabushiki Kaisha, Tokyo (JP)

( * ) Notice: Subject to any disclaimer, the term of this patent is extended or adjusted under 35 U.S.C. 154(b) by 874 days.

(21) Appl. No.: 10/061,294

(22) Filed: Feb. 4, 2002

(65) Prior Publication Data

US 2002/0150263 A1 Oct. 17, 2002

(30) Foreign Application Priority Data

Feb. 7, 2001 (GB) ..... 0103069.1

(51) Int. Cl.
*H04R 3/00* (2006.01)

(52) U.S. Cl. ..... 381/92; 379/202.01; 379/206.01

(58) Field of Classification Search ..... 381/92; 348/14; 379/202.01, 206.01
See application file for complete search history.

(56) References Cited

U.S. PATENT DOCUMENTS

| | | | | |
|---|---|---|---|---|
| 4,876,549 | A | 10/1989 | Masheff | 342/417 |
| 4,910,719 | A | 3/1990 | Thubert | 367/125 |
| 5,477,230 | A | 12/1995 | Tsui | 342/442 |
| 5,479,522 | A | 12/1995 | Lindemann et al. | 381/68.2 |
| 5,539,859 | A | 7/1996 | Robbe et al. | 395/2.42 |
| 6,317,501 | B1 | 11/2001 | Matsuo | 381/92 |
| 6,430,528 | B1 | 8/2002 | Jourjine | 704/200 |
| 6,469,732 | B1 * | 10/2002 | Chang et al. | 348/14.08 |
| 6,774,934 | B1 * | 8/2004 | Belt et al. | 348/211.1 |
| 6,826,284 | B1 * | 11/2004 | Benesty et al. | 381/92 |
| 6,868,365 | B2 * | 3/2005 | Balan et al. | 702/180 |
| 2001/0031053 | A1 * | 10/2001 | Feng et al. | 381/92 |

FOREIGN PATENT DOCUMENTS

| | | |
|---|---|---|
| EP | 1 006 652 A2 | 7/2000 |
| GB | 2 140 558 A | 11/1984 |
| JP | 11-18194 | 1/1999 |
| WO | WO 85/02022 | 5/1985 |
| WO | WO 96/27807 | 9/1996 |
| WO | WO 97/48252 | 12/1997 |
| WO | WO 00/28740 | 5/2000 |

OTHER PUBLICATIONS

Scott Rickard, et al., "DOA Estimation of Many W-Disjoint Orthogonal Sources From Two Mixtures Using Duet," IEEE Signal Processing Workshop on Statistical Signal and Array Processing, pp. 1-4, (SSAP 2000).

(Continued)

*Primary Examiner*—Brian T. Pendleton
(74) *Attorney, Agent, or Firm*—Fitzpatrick, Cella, Harper & Scinto.

(57) ABSTRACT

A signal processing system is provided which receives signals from a number of different sensors which are representative of signals generated from a plurality of sources. The sensed signals are processed to determine the relative position of each of the sources relative to the sensors. This information is then used to separate the signals from each of the sources. The system can be used, for example, to separate the speech signal generated from a number of users in a meeting.

12 Claims, 10 Drawing Sheets

OTHER PUBLICATIONS

Alexander N. Jourjine, et al., "Blind Separation of Disjoint Orthogonal Signals," IEEE Transactions on Signal Processing, pp. 1-14, (Jun. 2, 1999 and May 10, 2000).

Alexander Jourjine, et al., "Blind Separation of Disjoint Orthogonal Signals: Demixing N Sources From 2 Mixtures," IEEE International Conference on Acoustics, Speech, and Signal Processing, pp. 1-4, (ICASSP 2000).

Balan, R. et al., "The Influence of Windowing on Time Delay Estimates," *Proceedings of the 35th Annual Conference on Information Sciences & Systems* (CISS 2000), vol. 1, pp. WP1 (15-17), Princeton, New Jersey, Mar. 2000.

* cited by examiner 7
5-1
5-2
5-M
FILTER
21-1
21-2
21-M
A/D
23-1
23-2
23-M
BUFFER
25-1
25-2
25-M
DFT
27-1
27-2
27-M
BUFFER
29
SPECTROGRAM FOR MIC 1
31-1
SPECTROGRAM FOR MIC 2
31-2
31-M
SPECTROGRAM FOR MIC M
MEMORY
35
SPECTROGRAM PROCESSING MODULE
33
BUFFER
37-1
SPECTROGRAM FOR SOURCE 1
SPECTROGRAM FOR SOURCE 2
37-2
SPECTROGRAM FOR SOURCE 3
37-3
SPECTROGRAM FOR SOURCE N
37-N
39

SIGNAL PROCESSING SYSTEM

The present invention relates to a signal processing method and apparatus. The invention is particularly relevant to a spectral analysis of signals output by a plurality of sensors in response to signals generated by a plurality of sources. The invention can also be used to identify a number of sources that are present.

There exists a need to be able to process signals output by a plurality of sensors in response to signals generated by a plurality of sources in order to separate the signals generated by each of the sources. The sources may, for example, be different users speaking and the sensors may be microphones. Current techniques employ an array of microphones and an adaptive beamforming technique in order to isolate the speech from one of the users. This kind of beamforming system suffers from a number of problems. Firstly it can only isolate signals from sources that are spatially distinct and only the signal from one source at any one time. However, performance deteriorates if the sources are relatively close together since the "beam" which it uses has a finite resolution. It is also necessary to know the directions from which the signals of interest will arrive and also the exact spacing between the sensors in the sensor array. Further, if N sensors are available, then only N−1 "nulls" can be created within the sensing zone.

The aim of the present invention is to provide an alternative technique for processing the signals output from a plurality of sensors in response to signals received from a plurality of sources.

According to one aspect, the present invention provides a signal processing apparatus comprising: means for receiving a signal from two or more spaced sensors, each representing a signal generated from a source; first determining means for determining the relative times of arrival of the signal from the source at the sensor; second determining means for determining a parameter value of a function which relates the determined relative times of arrival to the relative positions of the sensors; and third determining means for determining the direction in which the source is located relative to the sensors from said determined function parameter.

Preferably, the apparatus receives signals from three or more spaced sensors and wherein the second determining means is operable to determine a parameter of a function which approximately relates the determined relative times of arrival to the relative positions of said sensors. By having three sensors, it is possible to determine how good the match is between the determined relative times of arrival and said parameter value of said function. It is therefore possible to discriminate between data points which match well to the function and those that do not.

Exemplary embodiments of the present invention will now be described with reference to the accompanying drawings in which.

Figure 1:
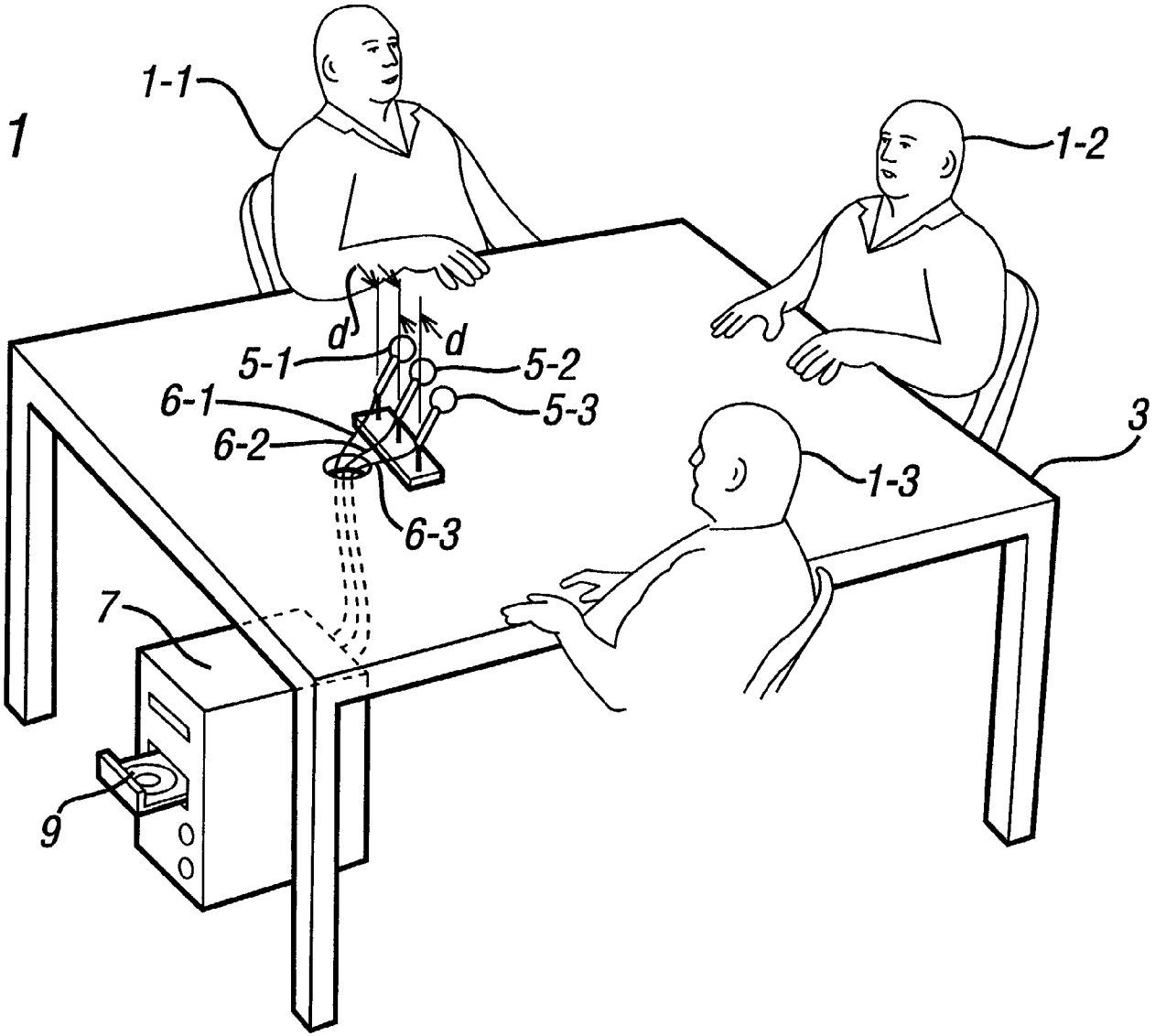
FIG. 1 is a schematic drawing illustrating a number of users participating in a conference and showing a number of microphones for detecting the speech of the users and a computer system for processing the speech signals from the microphones in order to separate the speech from each of the users.
Figure 2:
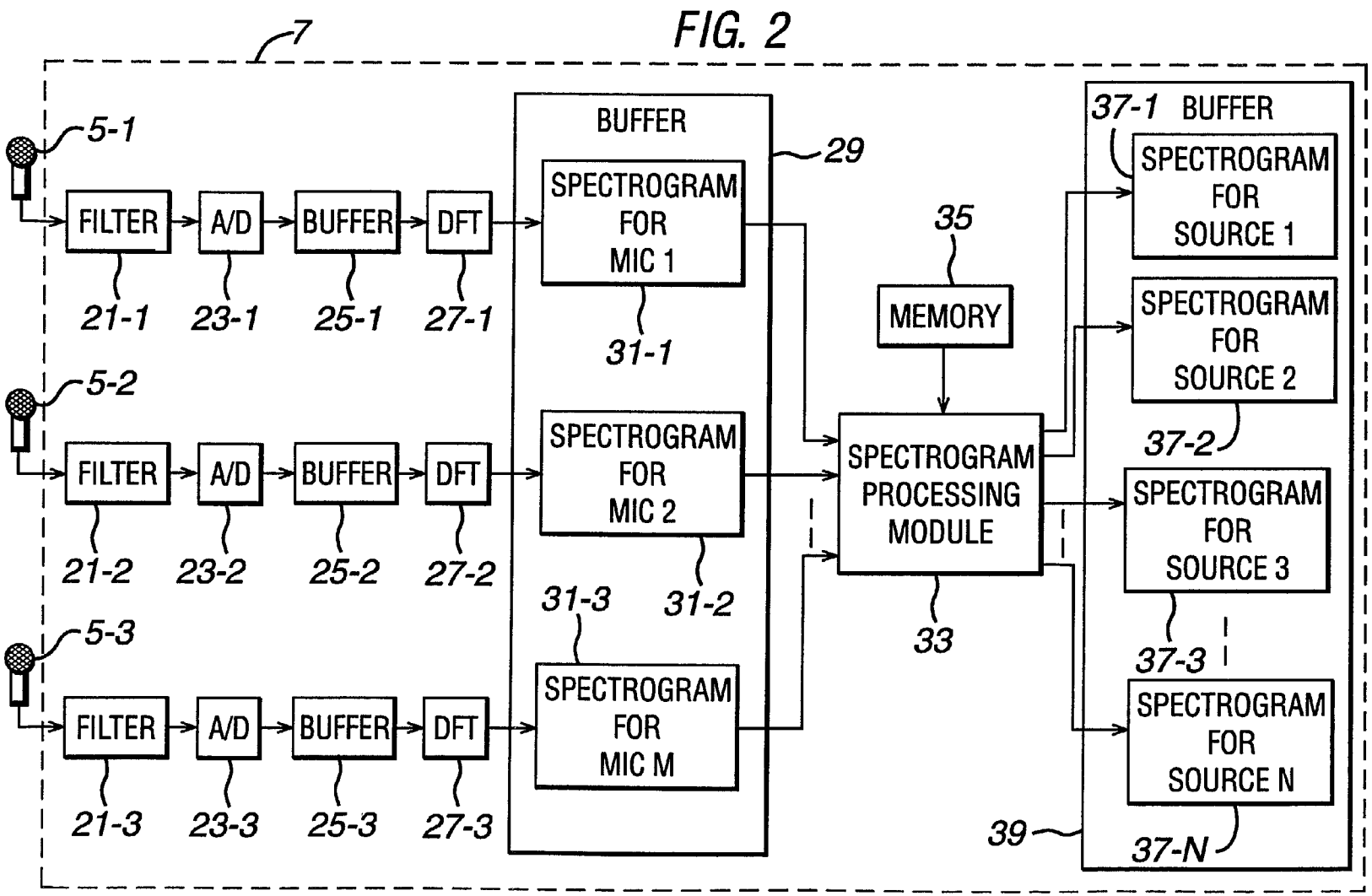
FIG. 2 is a schematic block diagram showing the microphones and the principal components of the computer system used to separate the speech from each of the users.
Figure 4:
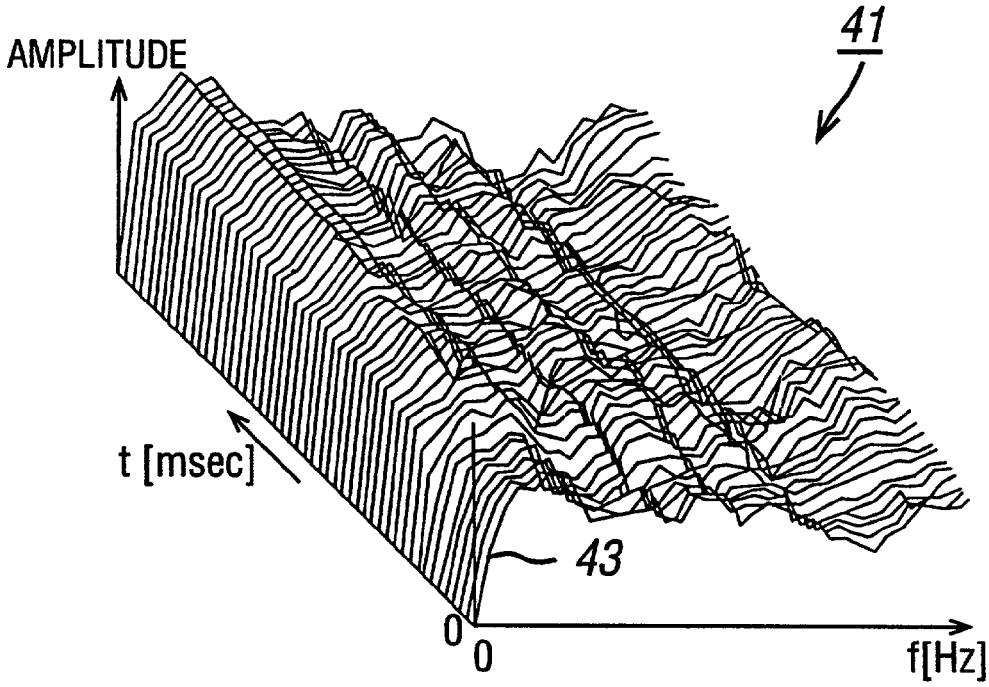
Figure 5A:
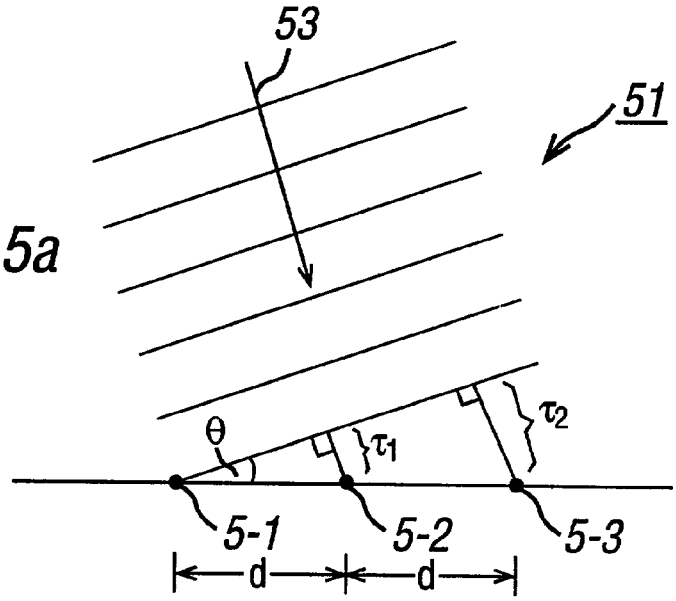
Figure 5B:
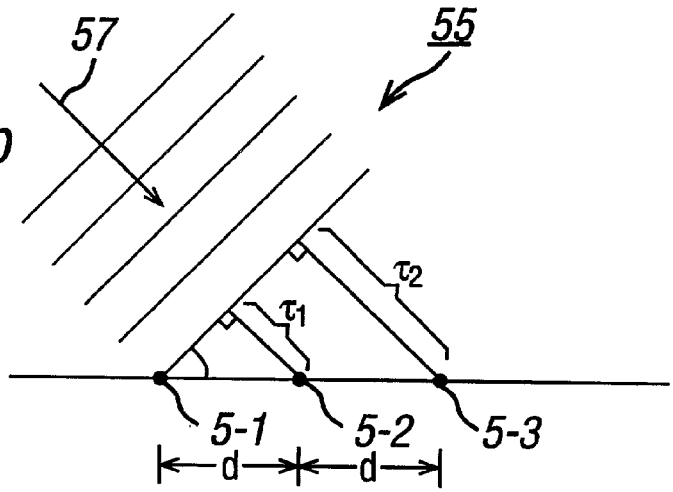
Figure 6:
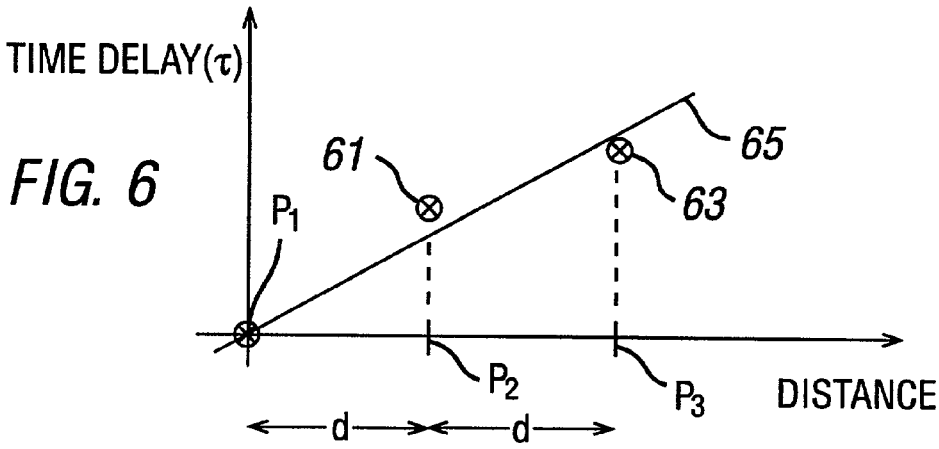
Figure 7:
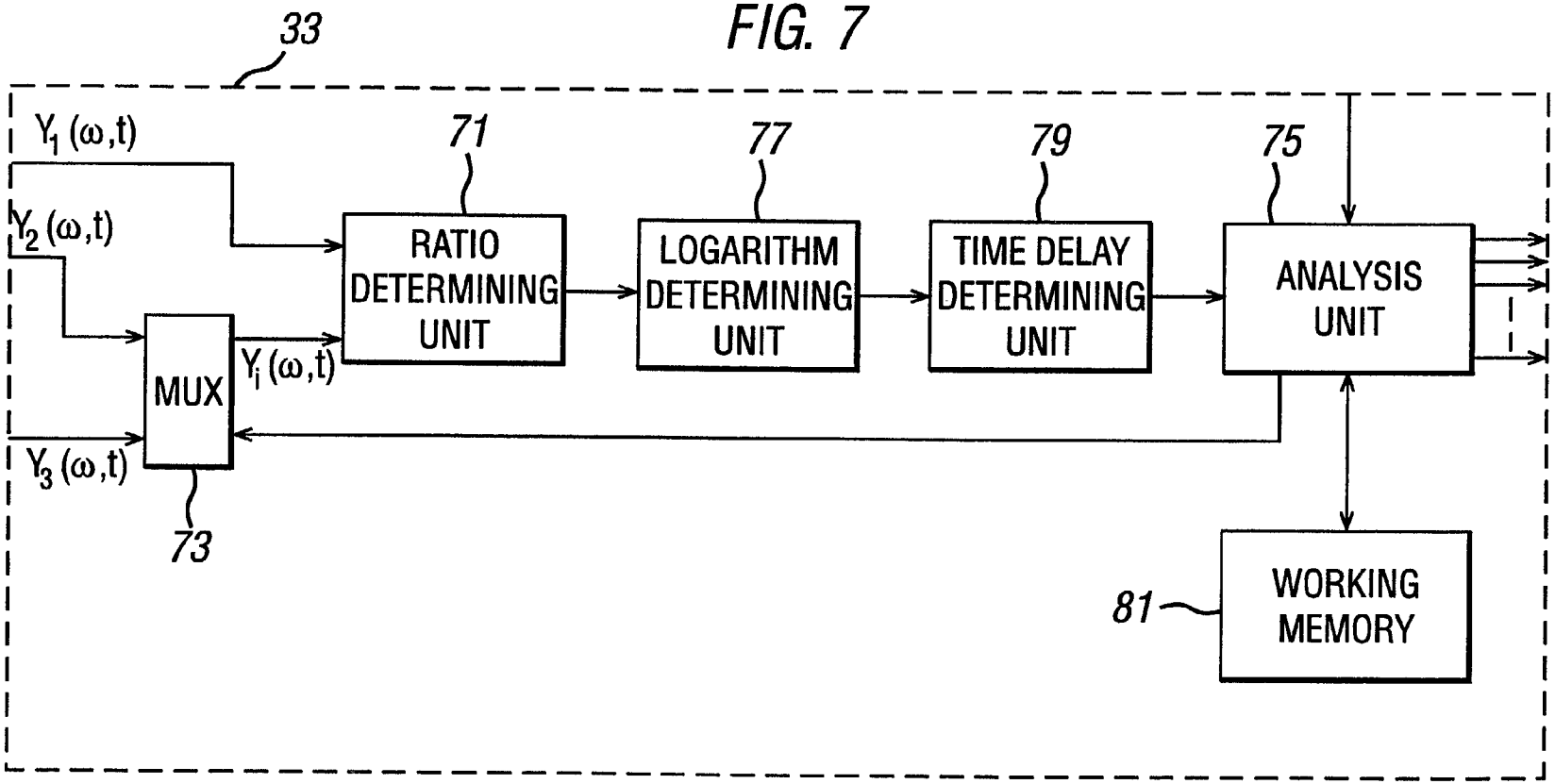
Figure 8A:
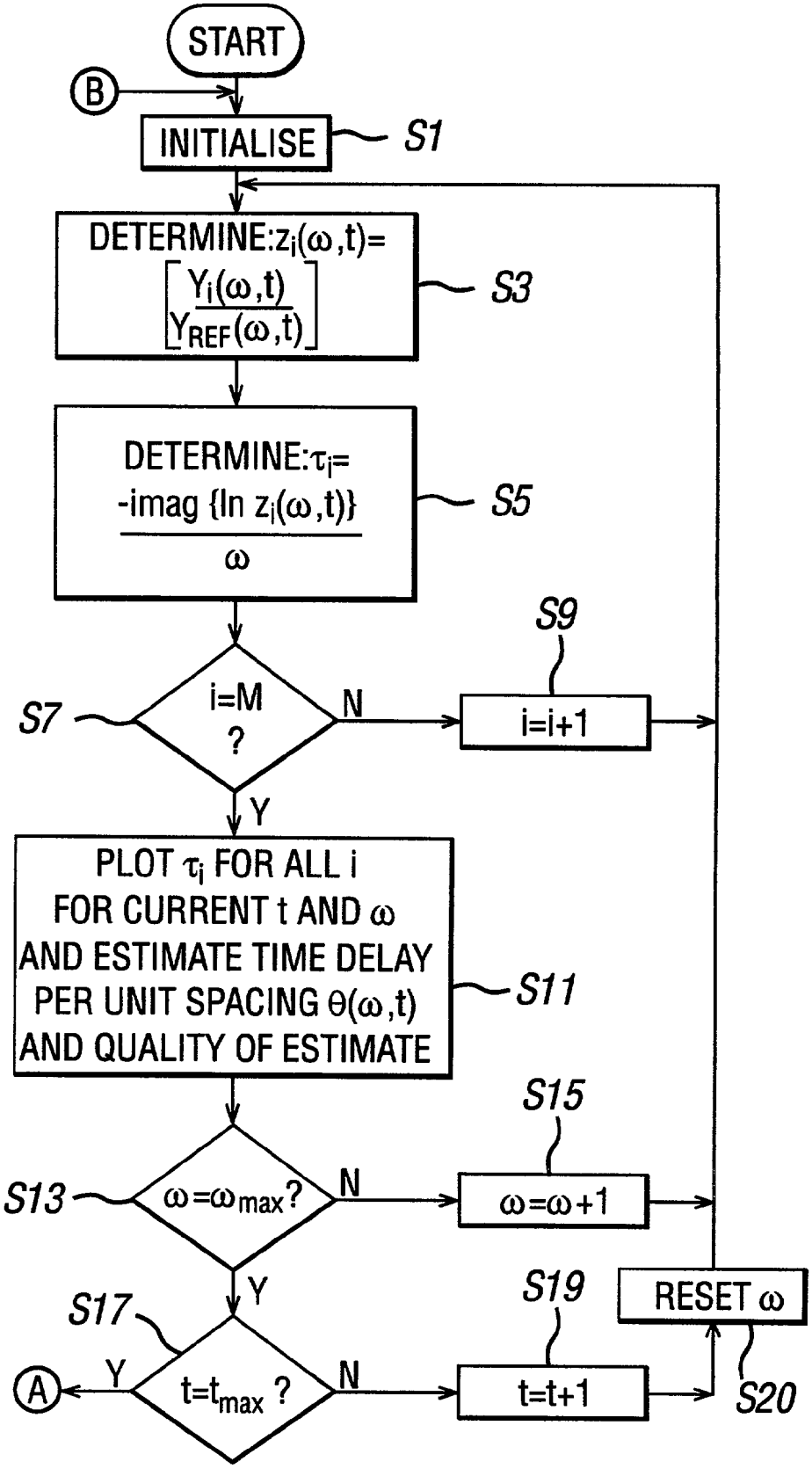
Figure 8B:
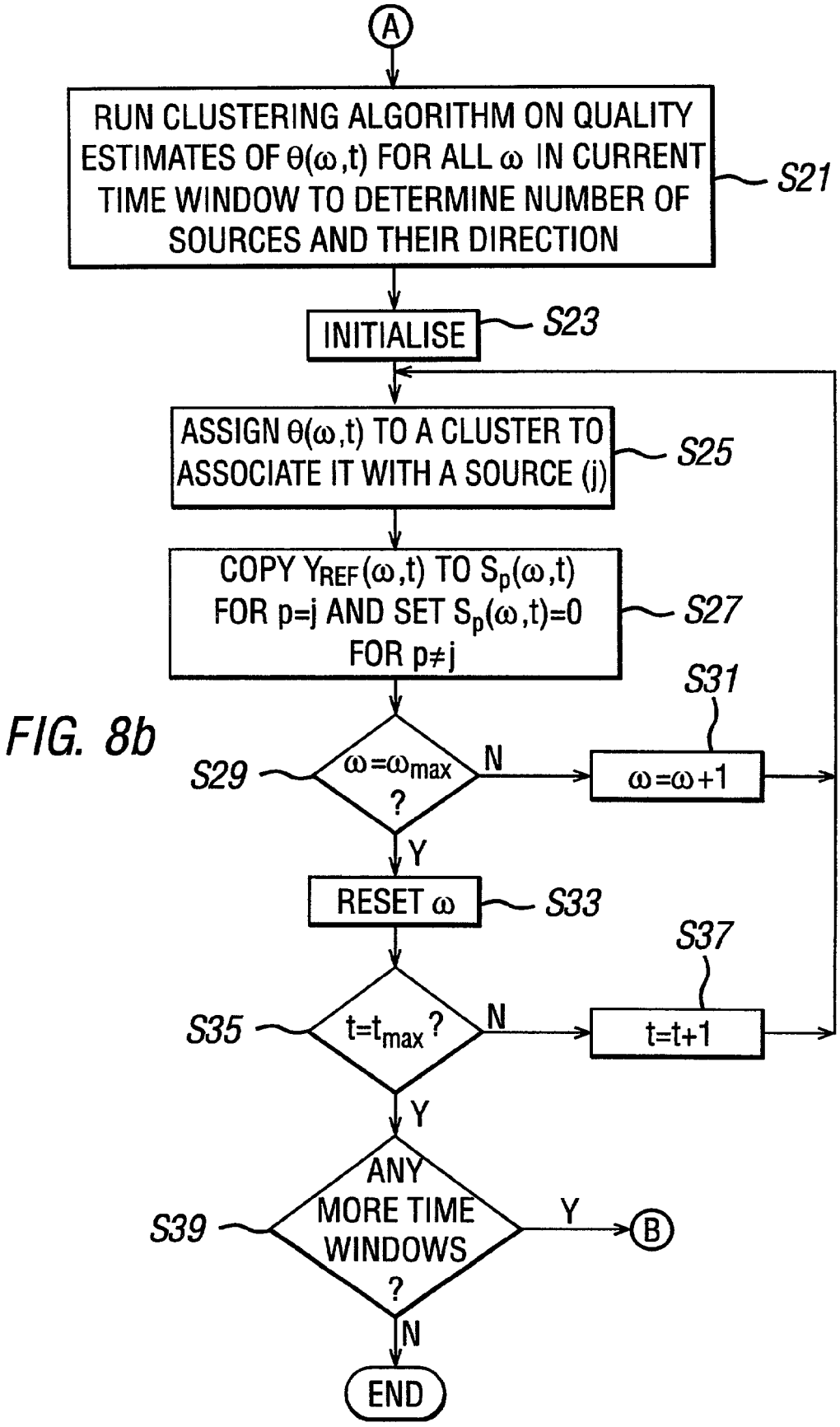
Figure 10:
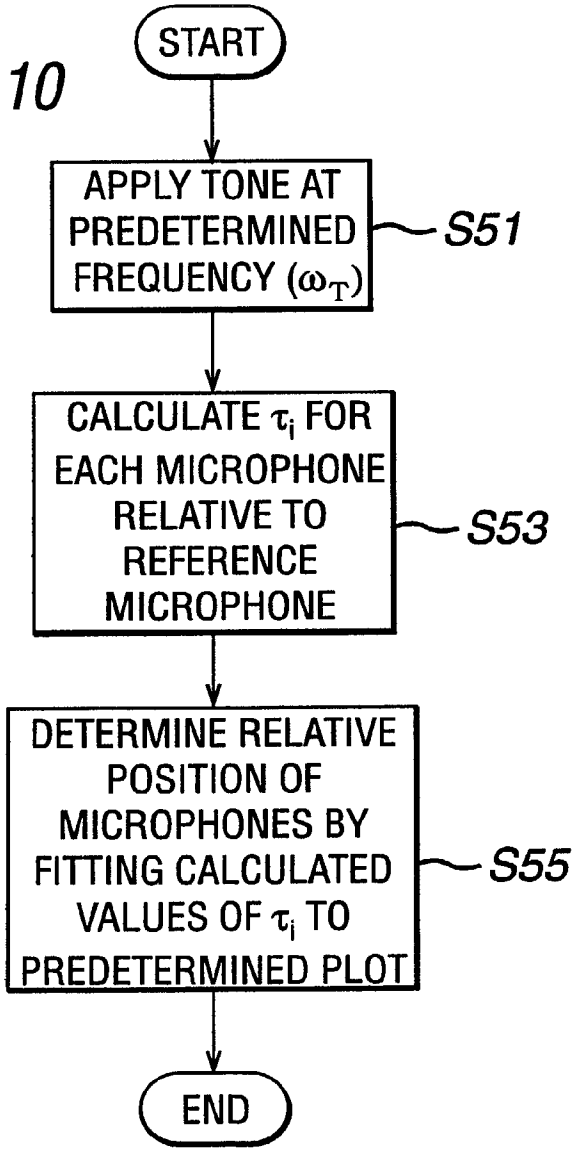
Figure 9:
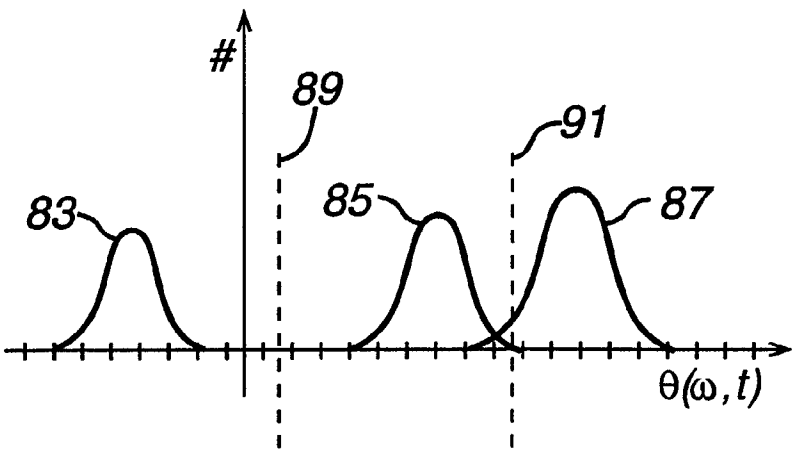
Figure 11:
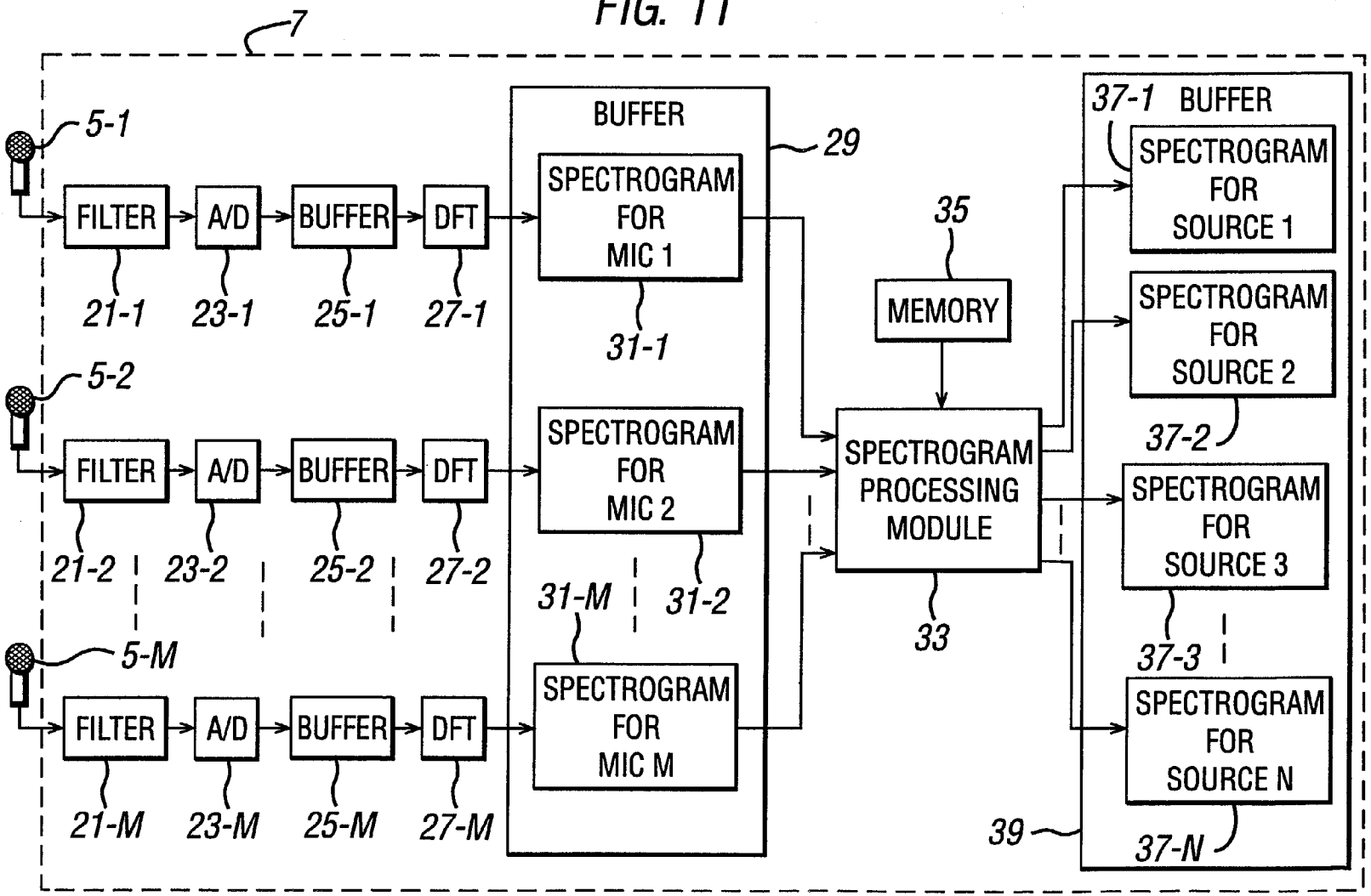
Figure 12:
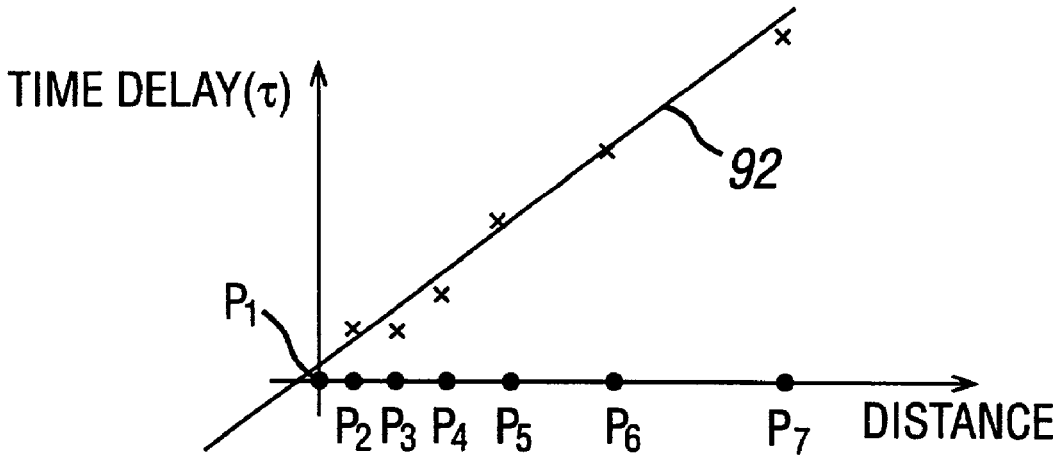
Figure 13:
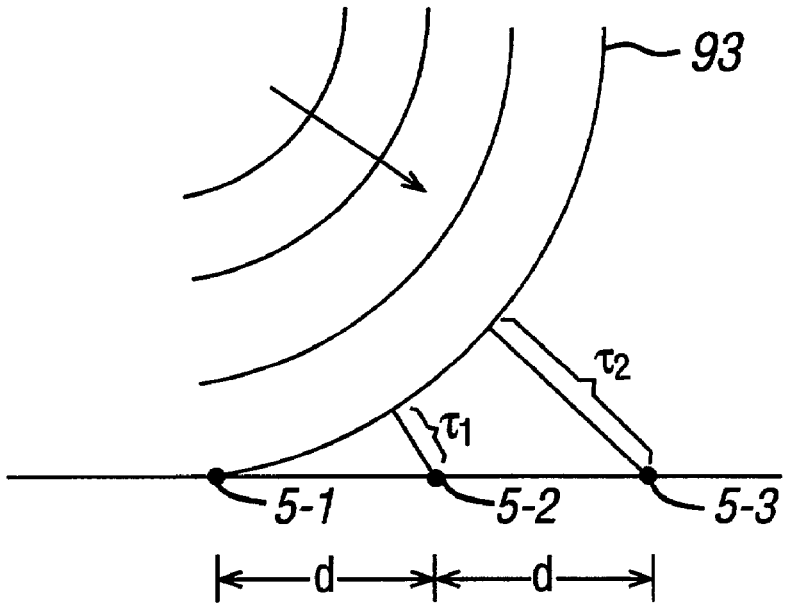

FIG. 4 schematically illustrates the form of a spectrogram for the speech signal output by one of the microphones shown in FIGS. 1 and 2;

FIG. 5*a* is a schematic diagram illustrating the way in which a set of planar waves (representative of an acoustic signal) propagate towards the microphones shown in FIG. 1 from a first direction;

FIG. 5*b* is a schematic diagram illustrating the way in which a set of planar waves (representative of an acoustic signal) propagate towards the microphones shown in FIG. 1 from a second direction;

FIG. 6 is a plot of the relative time delays of the signals received by the different microphones shown in FIGS. 1 and 2 for a speech signal generated by one of the users shown in FIG. 1 and illustrating a best straight line fit between those points;

FIG. 7 is a schematic diagram illustrating the principal components of a spectrogram processing module which forms part of the computer processing system shown in FIG. 2;

FIG. 8*a* is a flow chart illustrating a first part of the processing steps performed by the spectrogram processing module shown in FIG. 2;

FIG. 8*b* is a flow chart illustrating a second part of the processing steps performed by the spectrogram processing module shown in FIG. 2;

FIG. 9 is a histogram plot illustrating the distribution of quality time delay per unit spacing values obtained from the spectrogram processing module illustrated in FIG. 7;

FIG. 10 is a flow chart illustrating the steps performed in an automatic set up procedure;

FIG. 11 illustrates the main components of a computer system operating with M microphones which process the signals from the microphones to separate the signals from N sources;

FIG. 12 is a plot of the relative time delays of the signals received from eight different microphones and illustrating a best straight line fit between those points; and FIG. 13 is a schematic diagram illustrating the way in which a set of curved waves (representative of an acoustic signal) propagate towards the microphones shown in FIG. 1 from a source.

OVERVIEW

FIG. 1 schematically illustrates three users 1-1, 1-2 and 1-3 who are sitting around a table 3 having a meeting. An array of three microphones 5-1, 5-2 and 5-3 sits on the table 3. The microphones 5 are operable to detect the speech spoken by all of the users 1 and to convert the speech into corresponding electrical signals which are supplied, via cables 6-1, 6-2 and 6-3, to a computer system 7 located under the table 3. The computer system 7 is operable to record the speech signals on its hard disc (not shown) or on a CD ROM 9.

The computer system 7 is also arranged to process the signals from each of the microphones in order to separate the speech signals from each of the users 1-1, 1-2 and 1-3. The separated speech signals may then be processed by another computer system (not shown) for generating a speech recording or a text transcript of each user's speech.

The computer system 7 may be any conventional personal computer (PC) or workstation or the like. Alternatively, it may be a purpose built computer system which uses dedicated hardware circuits. In the case that the computer system 7 is a conventional personal computer or work station, the software for programming the computer to perform the above functions may be provided on CD ROM or may be downloaded from a remote computer system via, for example, the Internet.

Figure 3:
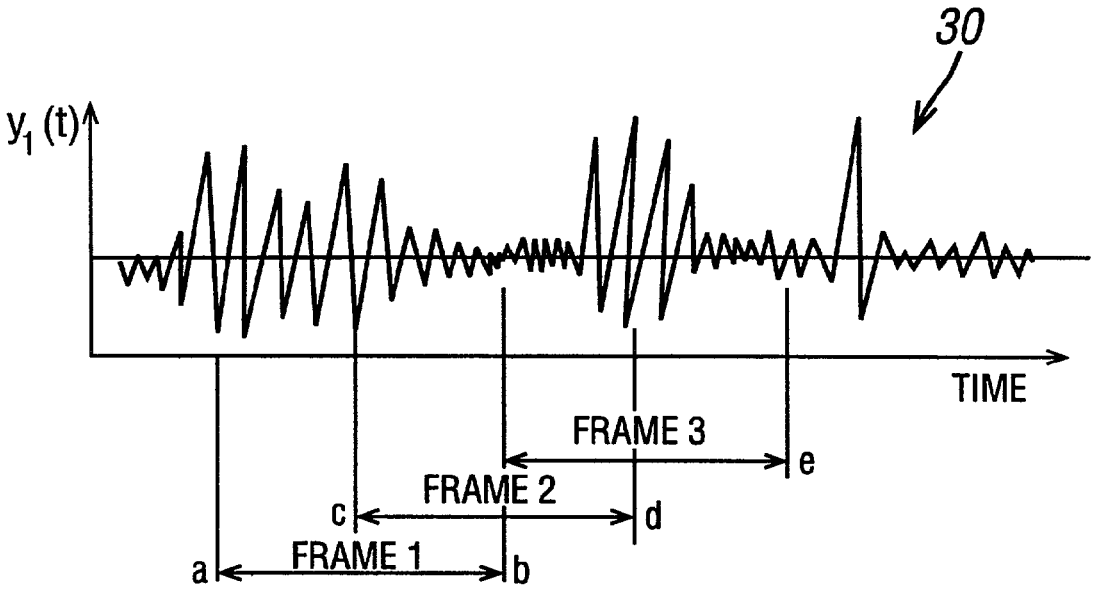
FIG. 3 is a plot of a typical speech waveform generated by one of the microphones illustrated in FIGS. 1 and 2 and illustrates the way in which the speech signal is divided into a number of overlapping time frames.

FIG. 2 shows a schematic block diagram of the main functional modules of the computer system 7 and how they connect to the microphones 5. As shown, electrical signals representative of the detected speech from each of the microphones 5 are input to a respective filter 21-1 to 21-3 which removes unwanted frequencies (in this embodiment frequencies above 8 kHz) within the input signals. The filtered signals are then sampled (at a rate of 16 kHz) and digitized by a respective analogue to digital converter 23-1 to 23-3 and the digitized speech samples are then stored in a respective buffer 25-1 to 25-3. In this embodiment, the input speech is then divided into overlapping equal length frames of speech samples, with a frame being extracted every 10 milliseconds and each frame corresponding to 20 milliseconds of speech. With the above sampling rate, this results in 160 samples per frame. The division of the speech into overlapping frames is illustrated in FIG. 3. In particular, FIG. 3 shows a speech signal $y_1(t)$ 30 generated from the first microphone 5-1 and illustrates the way in which the speech signal is divided into overlapping frames. In particular, frame 1 extends from time instant "a" to time "b"; frame 2 extends from time instant "c" to time instant "d" and frame 3 extends from time instant "b" to time instant "e". Due to the choice of the frame rate and frame length discussed above, adjacent frames overlap half of each of its neighbouring frames.

Returning to FIG. 2, the frames of speech stored in the buffers 25 are then passed to a respective DFT unit 27-1 to 27-3 which determines the discrete Fourier transform of the speech within the frames. In addition to carrying our a DFT on the speech samples, the DFT units 27 also window the frames of speech in order to reduce frequency distortion caused by extracting the frames from the sequence. Various windowing functions can be used such as Hamming, Hanning, Blackman etc. These types of windowing functions are well known to those skilled in the art of speech analysis and will not be described in further detail here. As shown in FIG. 2, the discrete Fourier transforms calculated by the DFT unit 27-1 over a predetermined time window are combined in a buffer 29 to form a spectrogram 31-1 for the speech signal output by the microphone 5-1. Similarly, the discrete Fourier transforms output by the DFT units 27-2 and 27-3 over the same predetermined window are combined to form spectrograms 31-2 and 31-3 (which are also stored in the buffer 29) for the speech output by microphones 5-2 and 5-3 respectively.

FIG. 4 schematically illustrates a typical spectrogram 41 which is generated for a speech signal over a predetermined time window of approximately 0.5 seconds. As shown, the spectrogram is formed by stacking the Fourier transforms in a time sequential manner. The spectrogram therefore shows how the distribution of energy with frequency within the speech signal varies with time. As those skilled in the art will appreciate, although the transforms shown in FIG. 4 are continuous waveforms, since a discrete Fourier transform is being calculated, only samples of each of the transforms at a plurality of discrete frequencies will be generated. Therefore, the spectrogram for a predetermined window of speech can be represented by a two dimensional array of values with one dimension representing time and the other dimension representing frequency and with each stored value representing the calculated DFT coefficient for that time and frequency.

Returning to FIG. 2, it is these two dimensional arrays of values that are stored in the buffer 29 as the spectrograms 31. The spectrograms 31 are then processed by the spectrogram processing module 33 in accordance with program instructions stored in memory 35. As will be described in more detail below, the spectrogram processing module 33 processes the spectrograms in order to identify the number of users who are speaking and a respective spectrogram 37-1 to 37-N for those speakers, which are stored in the buffer 39. The spectrograms for each of the users can then be used either to regenerate the speech of the user or they may be processed by a speech recognition system (not shown) in order to convert each of the user's speech into a corresponding text transcript.

A more detailed description of the spectrogram processing module 33 will now be given together with a brief description of the theory underlying the operation of the spectrogram processing module 33.

Theory

The speech signals output from the microphones 5 may be represented by:

$$y_1(t)=h_{11}*s_1(t)+h_{12}*s_2(t)+h_{13}*s_3(t)$$

$$y_2(t)=h_{21}*s_1(t)+h_{22}*s_2(t)+h_{23}*s_3(t)$$

$$y_3(t)=h_{31}*s_1(t)+h_{32}*s_2(t)+h_{33}*s_3(t) \quad (1)$$

where $y_i(t)$ is the speech signal output from microphone i; $h_{ij}$ represents the acoustic channel between the ith microphone and the jth user; $s_i$ is the speech from the ith user; and * represents the convolution operator. The Fourier transform of these signals gives:

$$Y_1(\omega)=H_{11}S_1(\omega)+H_{12}S_2(\omega)+H_{13}S_3(\omega)$$

$$Y_2(\omega)=H_{21}S_1(\omega)+H_{22}S_2(\omega)+H_{23}S_3(\omega)$$

$$Y_3(\omega)=H_{31}S_1(\omega)+H_{32}S_2(\omega)+H_{33}S_3(\omega) \quad (2)$$

where ω is the frequency operator. FIG. 5*a* is a schematic diagram illustrating the way in which a set of planer waves 51 (representative of a speech signal generated by the user 1-2 shown in FIG. 1) propagate towards the microphones 5. As shown in FIG. 5*a*, the planar waves propagate in a direction (represented by the arrow 53) such that they reach the first microphone 5-1 first then the second microphone 5-2 and then the third microphone 5-3. Assuming that the channels between each of the users 1 and the microphones 5 are similar, then the speech signal 51 arriving at the second microphone 5-2 will be an attenuated and time delayed version of the speech signal arriving at microphone 5-1. Similarly, the speech signal arriving at microphone 5-3 will be a further attenuated and time delayed version of the speech signal arriving at the first microphone 5-1. Since the speech signals travel at a constant speed through the atmosphere, the time delay between the arrival of the speech signals at the different microphones depends upon the separation between the microphones and the direction in which the speech signals are propagating. (This is illustrated in FIG. 5*b* which shows a second set of planar waves 55 representative of a speech signal generated by user 1-1 shown in FIG. 1. In this case, since the speech signal 55 approaches the microphones from a shallower angle (in the direction represented by the arrow 57) the time delays of the arrival of the speech signals at microphones 5-2 and 5-3 are greater than for the speech signal shown in FIG. 5*a*.) Therefore equation (2) can be simplified to:

$$Y_1(\omega)=(\hat{S})_1(\omega)+\hat{S}_2(\omega)+\hat{S}_3(\omega)$$

$$Y_2(\omega)=a_{21}e^{-j\omega\tau_{21}}\hat{S}_1(\omega)+a_{22}e^{-j\omega\tau_{22}}\hat{S}_2(\omega)+a_{23}e^{-j\omega\tau_{23}}\hat{S}_3(\omega)$$

$$Y_3(\omega)=a_{31}e^{-j\omega\tau_{31}}\hat{S}_1(\omega)+a_{32}e^{-j\omega\tau_{32}}\hat{S}_2(\omega)+a_{33}e^{-j\omega\tau_{33}}\hat{S}_3(\omega) \quad (3)$$

where $a_{ij}$ represents the relative attenuation of the speech signal from source j between the reference microphone (in this embodiment microphone 5-1) and the ith microphone; and $\tau_{ij}$ represents the time delay of arrival of the speech signal from the jth source at the ith microphone relative to the corresponding time of arrival at the reference microphone (which may have a positive or negative value). Taking the natural logarithms of the Fourier transforms given in equation 3 gives:

$$ln\ Y_1(\omega)=|Y_1(\omega)|+i.\phi(Y_1(\omega))$$

$$ln\ Y_2(\omega)=|Y_2(\omega)|+i.\phi(Y_2(\omega)) \quad (4)$$

Therefore, the phase difference between the signal arriving at the second microphone 5-2 and the signal arriving at the first microphone 5-1 is:

$$\varphi(Y_1(\omega))-\varphi(Y_2(\omega))=-\text{imag}\left[\ln\left(\frac{Y_2(\omega)}{Y_1(\omega)}\right)\right] \quad (5)$$

and the phase difference between the signal arriving at the third microphone 5-3 and the signal arriving at the first microphone 5-1 is:

$$\varphi(Y_1(\omega))-\varphi(Y_3(\omega))=-\text{imag}\left[\ln\left(\frac{Y_3(\omega)}{Y_1(\omega)}\right)\right] \quad (6)$$

If it is assumed that during a particular frame (t) and at a particular frequency (ω) the speech signal from one of the users (r) is much larger than the speech signals from the other users, then the relative time delays ($\tau_{2r}$ and $\tau_{3r}$) can be determined from:

$$\tau_{2r}=\frac{-\text{imag}\{\ln Z_{2r}(\omega)\}}{\omega} \quad (7)$$

$$\tau_{3r}=\frac{-\text{imag}\{\ln Z_{3r}(\omega)\}}{\omega} \quad (8)$$

where $$Z_{2r}=\left(\frac{Y_2(\omega)}{Y_1(\omega)}\right) \text{ and } Z_{3r}=\left(\frac{Y_3(\omega)}{Y_1(\omega)}\right)$$

If the assumptions above are correct and these values of the time delay are plotted on a Cartesian plot against the distance between the microphones, then there should be a straight line which approximately connects the points with the origin. This is shown in FIG. 6. The origin represents the position and time delay associated with the reference microphone 5-1 and the points 61 and 63 represent the determined values of time delay for the second and third microphones 5-2 and 5-3 respectively. As shown, these time delay values are plotted at points $p_2$ and $p_3$ on the x-axis which corresponds to the separation (d) between the microphones in the array shown in FIG. 1. FIG. 6 also shows a straight line plot 65 which is the determined best straight line fit for the points 61, 63 and the origin. The straight line fit 65 can be determined using any conventional technique. As those skilled in the art will appreciate, the gradient of the line 65 will depend upon the direction (θ) from which the dominant speech component is received. Therefore, by analysing all of the elements in the spectrograms stored in the buffer 29 using this technique, the number of sources can be determined (by determining the number of different directions from which speech is received) together with their approximate position relative to the array of microphones. This information can then be used to separate the speech from the individual users.

Spectrogram Processing Module

FIG. 7 is a schematic block diagram illustrating the main components of the spectrogram processing module 33 shown in FIG. 2. As shown, the values ($Y_1(\omega,t)$) stored in the spectrogram 31-1 are supplied directly to a ratio determining unit 71. The values $Y_2(\omega,t)$ and $Y_3(\omega, t)$ from the other two spectrograms 31-2 and 31-3 are supplied sequentially to the ratio determining unit 71 through a multiplexer 73 which is controlled by an analysis unit 75. The ratio determining unit 71 determines the ratio of the spectrogram value output from the multiplexor 73 (i.e. $Y_i(\omega,t)$) and the corresponding spectrogram value from the reference spectrogram (i.e. $Y_1(\omega,t)$). The logarithm determining unit 71 then determines the natural logarithm of the ratio output by the ratio determining unit 73. This logged value is then passed to a time delay determining unit 79 which determines the time delay for the multiplexed spectrogram component using equation (7) or (8) given above. This time delay value is then passed to the analysis unit 75 which stores the value in a working memory 81 in a location associated with the current frequency (ω) and frame (t) being processed, and then triggers the multiplexer 73 so that the other one of the two spectrogram values for this frame (t) and frequency (ω) is passed through the multiplexer 73. A similar calculation is then performed using the processing units 71, 77 and 79 in order to determine the time delay for the other spectrogram value. This time delay value is also past to the analysis unit 79 which stores the value in memory 81 in a location associated with the current frequency (ω) and frame (t) and then causes the next set of spectrogram values stored in the spectrograms 31-1, 31-2 and 31-3 to be retrieved from the buffer 29. In this embodiment, once time delays have been calculated for all of the spectrogram values stored in the spectrograms 31, the analysis unit 75 analyses the time delays to determine the number of users speaking and to determine a spectrogram for each of those users.

FIG. 8 is a flow chart showing the processing steps performed by the spectrogram processing module 33 in more detail. As shown, in step S1, the spectrogram processing module 33 is initialised. This involves initialising a spectrogram loop pointer, i, which is used to loop through each of the non-reference spectrograms stored in the buffer 29; and a frequency loop pointer, ω, and a time loop pointer, t, which are used to loop through each of the spectrogram values in the spectrograms 31 stored in the buffer 29. In this embodiment, loop pointer i is initialised to two (since the signal from the first microphone 5-1 is taken to be the reference signal and the loop pointers ω and t are set to one. The processing then proceeds to step S3 where the spectrogram processing module 33 determines the natural logarithm of the ratio of the spectrogram values $Y_i(\omega,t)$ and $Y_{REF}(\omega,t)$, which are retrieved from the appropriate spectrograms 31 stored in the buffer 29 (as mentioned above, in this embodiment, the reference spectrogram values are taken from the spectrogram 31-1). The processing then proceeds to step S5 where the spectrogram processing module 33 determines the relative time delay for the current spectrogram value being processed ($\tau_i$) using equation (7) or (8). The processing then proceeds to step S7 where the spectrogram processing module 33 compares the current value of the spectrogram processing loop pointer i with the number of microphones M (which in this embodiment equals three) in the microphone array. If i does not equal M, then the processing proceeds to step S9 where the current spectrogram loop pointer i is incremented by one and then the processing returns to step S3.

Once all the non-reference spectrogram values for the current frequency and time have been processed through steps S3 and S5, the processing proceeds to step S11 where the spectrogram processing module 33 plots the determined time delays ($\tau_i$) and fits a straight line to these points, the gradient of which corresponds to the estimated time delay per unit spacing ($\theta(\omega,t)$) for the current frequency ($\omega$) and time frame (t). In this embodiment, this is done by adjusting the slope of the line until the sum of the square of deviations of the points from the line is minimised. This can be determined using standard least mean square (LMS) fit techniques. The spectrogram processing module 33 also uses the determined minimum sum of the square of the deviations as a quality measure of how good the straight line fits these points. This estimate of the time delay per unit spacing and the quality measure for the estimate are then stored in the working memory 81. The processing then proceeds to step S13 where the spectrogram processing module 33 compares the frequency loop pointer ($\omega$) with the maximum frequency loop pointer value ($\omega_{max}$), which in this embodiment is 256. If the current value of the frequency loop pointer ($\omega$) is not equal to the maximum value then the processing proceeds to step S15 where the frequency loop pointer is incremented by one and then the processing returns to step S3 where the above processing is repeated for the next frequency component of the current time frame (t) of the spectrograms 31.

Once the above processing has been performed for all the frequency components for the current frame, the processing proceeds to step S17 where the frame loop pointer (t) is compared to the value $t_{max}$ which defines the time window over which the spectrograms 31 extend. For example, for the spectrogram shown in FIG. 4, there are 49 spectrum functions plotted. Therefore, in this case, $t_{max}$ would have a value of 49. If at step S17 the frame loop pointer t is not equal to $t_{max}$, then the processing proceeds to step S19 where the frame loop pointer (t) is incremented by one. The processing then proceeds to step S20 where the frequency loop pointer $\omega$ is reset to one and then the processing returns to step S3 so that the discrete Fourier transform values of the spectrograms for the next frame are processed in the manner described above.

Once the above processing has been performed for all the values in the spectrograms 31, the processing proceeds to step S21 where the spectrogram processing module 33 performs a clustering algorithm on the high quality estimates of the time delay per unit spacing ($\theta(\omega,t)$) values. In this embodiment, the high quality estimates are the estimates for which the corresponding quality measures (i.e. the sum of the square of the deviations) are below a predetermined threshold value. Alternatively, the system may decide to choose the best N estimates. As those skilled in the art will appreciate, running the clustering algorithm on only high quality estimates ensures that only those calculations for which the above assumptions hold true, are processed to identify the number of clusters within the estimates and hence the number of users speaking in the current time window.

FIG. 9 is a plot illustrating the results of the clustering algorithm when the three users 1 shown in FIG. 1 are talking in the time window corresponding to the current set of spectrograms 31 being processed. In particular, FIG. 9 is a histogram plot illustrating the distribution of quality time delay per unit spacing values ($\theta(\omega,t)$). As shown, these values are grouped in three clusters 83, 85 and 87, one for each of the three users 1-1, 1-2 and 1-3. In this illustration, the distribution of the time delay per unit spacing values within each cluster are approximately Gaussian. The spectrogram processing module 33 then determines the mean value for each of the clusters and uses these values to assign each of the clusters to one of the users 1. This association between the clusters and the users is stored in the memory 81 and is used, as will be described below, in order to generate spectrograms for each of the users. The mean values are also used to identify appropriate boundary values 89 and 91 which can be used to separate each of the clusters.

Once the quality estimates of the time delay per unit spacing values have been clustered, the processing then proceeds to step S23 where the frequency pointer ($\omega$) and the frame pointer (t) are initialised to one. The processing then proceeds to step S25 where the current time delay per unit spacing value ($\theta(\omega,t)$) is assigned to one of the three clusters 83, 85 or 87. This is achieved by comparing the current time delay per unit spacing value with the boundary values 89 and 91. In particular, if the current time delay per unit spacing value is less than the boundary value 89, then it is assigned to cluster 83; if the current time delay per unit spacing value lies between the boundary value 89 and 91 then it is assigned to cluster 85; and if the current time delay per unit spacing value is greater than the boundary value 91, then it is assigned to cluster 87. By assigning the current delay per unit spacing value to a cluster, the spectrogram processing module 33 effectively identifies the speech source (j) from which the corresponding signal value has been received. Accordingly, the corresponding value from the reference spectrogram 31-1 is copied to the corresponding value of the spectrogram 37-j for the identified source (j) and the other corresponding spectrogram values in the other source spectrograms 37 are set to equal zero. In other words, in step S27, the spectrogram processing module 33 copies $Y_{REF}(\omega,t)$ to $S_p(\omega,t)$ for p=j and sets $S_p(\omega,t)$ to zero for p≠j. The processing then proceeds to step S29 where the spectrogram processing module 33 compares the frequency loop pointer ($\omega$) with the maximum frequency loop pointer ($\omega_{max}$). If the current value of the frequency loop pointer ($\omega$) is not equal to the maximum value, then the processing proceeds to step S31 where the frequency loop pointer ($\omega$) is incremented by one and then the processing returns to step S25 so that the next time delay per unit spacing value is processed in a similar manner.

Once the above processing has been performed for all the time delay per unit spacing values in the current time frame, the processing proceeds to step S33 where the frequency loop pointer ($\omega$) is reset to one. The processing then proceeds to step S35 where the frame loop pointer (t) is compared to the value ($t_{max}$) which defines the number of frames in the spectrograms. If there are further frames to be processed, then the processing proceeds to step S37 where the frame loop pointer (t) is incremented by one so that the time delay per unit spacing values that were calculated for the next time frame can be processed in the manner described above. Once all the time delay per unit spacing values derived from the current spectrograms 31 have been processed, the processing then proceeds to step S39 where the spectrogram processing module 33 determines whether or not there are any more time windows to be processed in the manner described above. If there are, then the processing returns to step S1. Otherwise, the processing ends.

As those skilled in the art will appreciate, during the processing of the next time window, one or more of the speakers may have stopped speaking. In this case, the corresponding cluster of time delay per unit spacing values will not be present in the corresponding histogram plot. In this case, when the spectrogram processing module 33 generates the spectrograms for each of the sources, zero values are input to the spectrogram for the source for the user who is not speaking. Further, if one or more of the users moves relative to the array of microphones 5, then the position of the corresponding cluster in the histogram plot shown in FIG. 9 will move along the x-axis, depending upon where the user moves relative to the microphones 5. However, in view of the sampling rate and window size of the spectrograms, the spectrogram processing module 33 can track the movement of each of the users 1 by tracking the position of the corresponding cluster along the x-axis shown in FIG. 9. The only possible difficulty may arise if one of the users passes in front of or behind one of the other users. However, in this case, the spectrogram processing module 33 should be able to predict from the previous positions of the clusters shown in FIG. 9 and the way in which they have moved over time, which clusters belong to which users after the clusters separate again. Alternatively or in addition, the spectrogram processing module 33 could use standard speaker identification techniques to identify which clusters belong to which users after the clusters separate.

Automatic Calibration

In the above embodiment, the three microphones 5-1 to 5-3 were mounted on a common block in an array so that the spacing (d) between the microphones was fixed and known. The above processing can also be used in embodiments where three separate microphones are used which are not fixed relative to each other. In this case, however, a calibration routine must be carried out in order to determine the relative spacing between the microphones so that, in use, the time delay elements can be plotted at the appropriate position along the x-axis shown in the plot of FIG. 6. The flow chart shown in FIG. 10 illustrates one way in which this calibration routine may be performed. Initially, the separate microphones are placed in arbitrary positions, for example, on the table in front of the users. A tone generator (not shown) is then used to apply, in step S51, a tone at a predetermined frequency ($\omega_T$). Whilst this tone is output, the computer system 7 determines a spectrogram for the signal received by each of the microphones. The spectrogram processing module 33 assigns one of the microphones as the reference microphone and then determines the above described relative time delays ($\tau_i$) for each of the microphones relative to the reference microphone by analysing the spectrogram values at the frequency of the tone (i.e. $\omega_T$). The processing then proceeds to step S55 where the calculated values of the time delay ($\tau_i$) are fitted to a predetermined plot of the time delay against microphone separation, in order to determine the relative position of the microphones. In this embodiment, the predetermined plot is a straight line which passes through the origin and which has a predetermined gradient. Once these relative positions have been determined in this way, the system can then be used in the manner described above to separate the speech from each of the users. As those skilled in the art will appreciate, the straight line plot used in step S55 may have any gradient, provided that during use, the determined time delay values are plotted at the same relative positions along the x-axis.

As those skilled in the art will appreciate, the above calibration technique is considerably simpler than the calibration technique used in prior art systems which use several microphones. In particular, in the prior art systems, they require the microphones to be accurately positioned relative to each other in a known configuration. In contrast, with the technique described above, the microphones can be placed in any arbitrary position. Further, with the calibration technique described above, the tone signal generator can be placed almost anywhere relative to the microphones.

Modifications and Alternative Embodiments

In the above embodiment, three microphones were used to generate speech signals of the users in the meeting. Three microphones is the preferred minimum number of microphones used in the system, since this provides two relative time delay values to be determined which can then be plotted against a predetermined function in the manner described above, to determine the user from which the current portion of speech was generated. In contrast, if only two microphones are provided, then only one relative time delay value can be determined in which case, whilst it is possible to plot a straight line through this point and the origin, it will not be possible to identify whether or not the determined time delay per unit spacing value is an accurate one or not. In contrast, with three or more microphones, it will always be possible to fit the predetermined plot to the points and, depending on the goodness of the fit, to determine a measure of the quality of the determined time delay per unit spacing value (which identifies whether or not the assumptions discussed above are valid). Therefore, with three or more microphones, it is possible to identify the clusters more accurately, and hence to identify more accurately the number of speakers, the direction of the speakers relative to the microphones and spectrograms for each of the users.

As mentioned above, three microphones is the preferred minimum number of microphones used in this system. FIG. 11 is plot showing a general computer system having inputs for receiving speech signals from M microphones 5-1 to 5-M. As can be seen by comparing FIG. 11 with FIG. 2, the computer system 7 is substantially the same. The only difference is in the provision of separate processing channels for the speech from each of the M microphones. The processing performed by the spectrogram processing module 33 is substantially the same as in first embodiment except that it has more time delay values to plot in the corresponding plot of FIG. 6. The remaining processing steps performed by the spectrogram processing module 33 are the same as for the first embodiment and will not, therefore, be described again.

In the above embodiments, a separate processing channel was provided to process the signal from each microphone. In an alternative embodiment, the speech from all the different microphones may be stored into a common buffer and then processed, in a time multiplexed manner by a common processing channel. Such a single channel approach can be used where real time processing of the incoming speech is not essential. However, the multi-channel approach is preferred if substantially real time operation is desired. The single channel approach would also be preferred where dedicated hardware circuits for the speech processing would add to the cost and all the processing is done by a single processor under appropriate software control.

In the first embodiment described above, the three microphones 5-1, 5-2 and 5-3 were arranged in a linear array such that the spacing (d) between microphones 5-1 and 5-2 was the same as the spacing (d) between microphones 5-2 and 5-3. As those skilled in the art will appreciate, other arrangements of microphones may be used. For example, as discussed above, the microphones may be placed in arbitrary positions. Alternatively, the microphones 5 may be spaced apart in a logarithmic manner such that the spacing between adjacent microphones increases logarithmically. The corresponding time delay and distance plot for such an embodiment is illustrated in FIG. 12. As shown, in this embodiment, seven microphones are provided which results in six relative time delay values ($\tau_2$ to $\tau_7$) being calculated. As shown, these time delay values are plotted at the appropriate separation on the x-axis and an appropriate straight line fit 92 is found which best matches these determined time delay values.

In the above embodiment, discriminant boundaries between each of the clusters were determined using the mean values of the clusters. As those skilled in the art will appreciate, if the variances of the clusters are very different then the discriminant boundaries should be determined using both the means and the variances. The way in which this may be performed will be well known to those skilled in the art of statistical analysis and will not be described here.

In the above embodiments, the spectrogram processing module 33 assumes that the calculated time delay values should be plotted against a straight line. This assumption will hold provided that the users are not too close (e.g. <½ m) to the microphones. However, if one or more of the users are close to the microphones, then a different plot should be used, since the speech arriving at the microphones from that user will not be planar waves like those shown in FIG. 5. Instead, the speech will propagate towards the microphones with a curved wavefront. This is schematically illustrated in FIG. 13 by the curved speech waves 93 which propagate towards the microphones 5-1, 5-2 and 5-3. As shown, in this case, although the speech arrives from the same direction as the example shown in FIG. 5*b*, the values of $\tau_1$ and $\tau_2$ are smaller because of the curved shape 93 of the wavefront. In such an embodiment, the spectrogram processing module 33 would try to fit a predetermined curved plot similar to the shape of the wavefront shown in FIG. 13 against the determined values of the time delay. The predetermined curved plots used may be circular arcs, in which case, the spectrogram processing module 33 will be able to estimate, not only the direction from which the speech emanated, but also the distance from the microphones of that user (since it would be able to determine the centre of the circle corresponding to the circular arc which fits the determined time delay values).

As those skilled in the art will appreciate, if the users do move around, then sometimes they may be close to the microphones, in which case the spectrogram processing module 33 should try to fit a circular curve to the calculated time delay values, and in some cases the user may be far from the microphones, in which case the spectrogram processing module 33 should try to fit a straight line to the calculated time delay values. Therefore, in a preferred embodiment, the spectrogram processing module 33 not only tracks the direction of the users from the microphones, they also track the curves and/or straight lines which are used for each of the different users during each of the different time windows being analysed. In this way, when the system is initially set up, the spectrogram processing module 33 must try to match various different types of functions against the calculated time delay values for each of the different users. However, once these have been assigned, the spectrogram processing module 33 can then track the waveforms as they change with time since, it is unlikely that the frequency profile of the speech waveform will change considerably from one time window to the next.

In the above embodiments, relative time delay values were determined for each of the microphones relative to a reference microphone. These time delay values were then plotted and a function having a predetermined shape was fitted to the time delay values. The function which matched best with the determined time delay values was then used to determine the direction from which the speech emanated and hence who the speech corresponds to. In the embodiments described, this fitting of the predetermined function to the points was illustrated graphically. In practice, this will be achieved by analysing the co-ordinate pairs defined by the time delay values calculated for each microphone and the microphone's position relative to the other microphones, using equations defining the predetermined plots. Various numerical techniques for carrying out this type of calculation are described in the book entitled "Numerical Recipes in C" by W. Press et al, Cambridge University Press, 1992.

A system has been described above which can separate the speech received from a number of different users. The system may be used as a front end to a speech recognition system which can then generate a transcript of each user's speech even if the users are speaking at the same time. Alternatively, each individuals speech may be separately stored for subsequent playback purposes. The system can therefore be used as a tool for archiving purposes. For example, both the speech of the user may be stored together with a time indexed coded version of the audio (which may be text). In this way, users can search for particular parts of a meeting by finding words within the time synchronised text transcript.

A system has been described above which can separate the speech from multiple users even when they are speaking together. As those skilled in the art will appreciate, the system can be used to separate any mix of acoustic signals from different sources. For example, if there are a number of users playing musical instruments, then the system may be used to separate the music generated by each of the users. This can then be used in various music editing operations. For example it can be used to remove one or more of the musical instruments from the soundtrack.

The invention claimed is:

1. A signal processing apparatus comprising:

a receiver operable to receive a respective signal from three or more spaced sensors, each representing a signal generated from a source;

a first determiner operable to process the received sensor signals to determine the relative times of arrival of the signal from said source at said three or more spaced sensors;

a second determiner operable to process the determined relative times of arrival using a best fit analysis to determine a parameter of a function which models the shape of a wavefront of the signal generated by said source at said sensors and which relates said determined relative times of arrival to the relative positions of said sensors;

a third determiner operable to determine the direction in which said source is located relative to said sensors in dependence upon the determined function parameter;

a divider operable to divide each received signal into a plurality of time sequential segments;

an analyzer operable to analyze each segment of each received signal to determine a plurality of values representative of the frequency content of the signal in the segment at different frequencies, wherein said first determiner is operable to determine said relative times of arrival by comparing a current frequency value in a current time segment from a first one of said at least three sensors with a corresponding frequency value in a corresponding time segment from a second one of said at least three sensors, and wherein said second determiner is operable to determine a measure of the quality of the fit between the predetermined function having the determined function parameter and the relative times of arrival and the relative positions of said sensors; and an analyzer operable to analyze the determined function parameters for the different frequency values for which the quality measure is above a predetermined quality threshold, to identify a number of different groups of function parameters, each corresponding to a signal from a different source.

2. An apparatus according to claim 1, wherein said analyzer is operable to cluster said function parameters.

3. An apparatus according to claim 2, wherein said receiver is operable to receive a respective signal from said sensors, each representing signals generated from a plurality of sources, further comprising a separator operable to separate the signals generated from said plurality of sources, which separator comprises:

an assigner operable to assign each frequency component in each time segment to one of said groups of function parameters by comparing the corresponding function parameter determined for a current frequency value in a current time segment with said different groups; and a copier operable to copy the current frequency value in the current time segment from a first one of said at least three sensors into a store associated with the assigned group and a zero frequency value in the current time segment into corresponding stores for the other groups.

4. An apparatus according to claim 3, which is arranged to process said time segments in blocks and further comprising a tracker operable to track the position of said sources relative to said sensors in dependence upon the groups of function parameters determined for adjacent blocks of time segments.

5. An apparatus according to claim 3, further comprising a signal regenerator operable to regenerate the signal from each source using the frequency values in the store associated with each source.

6. A signal processing method comprising the steps of:

receiving a respective signal from three or more spaced sensors, each representing a signal generated from a source;

a first determining step of processing the received sensor signals to determine the relative times of arrival of the signal from said source at said three or more spaced sensors;

a second determining step of processing the determined relative times of arrival using a best fit analysis to determine a parameter of a function which models the shape of a wavefront of the signal generated by said source at said sensors and which relates said determined relative times of arrival to the relative positions of said sensors;

a third determining step of determining the direction in which said source is located relative to said sensors in dependence upon the determined function parameter;

a step of dividing each received signal into a plurality of time sequential segments;

a step of analyzing each segment of each received signal to determine a plurality of values representative of the frequency content of the signal in the segment at different frequencies, wherein said first determining step determines said relative times of arrival by comparing a current frequency value in a current time segment from a first one of said at least three sensors with a corresponding frequency value in a corresponding time segment from a second one of said at least three sensors;

a step of determining a measure of the quality of the fit between the predetermined function having the determined function parameter and the relative times of arrival and the relative positions of said sensors; and a step of analyzing the determined function parameters for the different frequency values for which the quality measure is above a predetermined quality threshold, to identify a number of different groups of function parameters, each corresponding to a signal from a different source.

7. A method according to claim 6, wherein said analyzing step comprises the step of clustering said function parameters.

8. A method according to claim 7, wherein said receiving step receives a respective signal from said sensors, each representing signals generated from a plurality of sources, further comprising the step of separating the signals generated from said plurality of sources comprising the steps of:

assigning each frequency component in each time segment to one of said groups of function parameters by comparing the corresponding function parameter determined for a current frequency value in a current time segment with said different groups; and copying the current frequency value in the current time segment from a first one of said at least three sensors into a store associated with the assigned group and a zero frequency value in the current time segment into corresponding stores for the other groups.

9. A method according to claim 8, which is arranged to process said time segments in blocks and further comprising the step of tracking the position of said sources relative to said sensors in dependence upon the groups of function parameters determined for adjacent blocks of time segments.

10. A method according to claim 8, further comprising the step of regenerating the signal from each source using the frequency values in the store associated with each source.

11. A computer readable medium storing computer executable instructions for causing a programmable computing device to carry out a signal processing method comprising the steps of:

receiving a respective signal from three or more spaced sensors, each representing a signal generated from a source;

a first determining step of processing the received sensor signals to determine the relative times of arrival of the signal from said source at said three or more spaced sensors;

a second determining step of processing the determined relative times of arrival using a best fit analysis to determine a parameter of a function which models the shape of a wavefront of the signal generated by said source at said sensors and which relates said determined relative times of arrival to the relative positions of said sensors;

a third determining step of determining the direction in which said source is located relative to said sensors in dependence upon the determined function parameter;

a step of dividing each received signal into a plurality of time sequential segments;

a step of analyzing each segment of each received signal to determine a plurality of values representative of the frequency content of the signal in the segment at different frequencies, wherein said first determining step determines said relative times of arrival by comparing a current frequency value in a current time segment from a first one of said at least three sensors with a corresponding frequency value in a corresponding time segment from a second one of said at least three sensors;

a step of determining a measure of the quality of the fit between the predetermined function having the determined function parameter and the relative times of arrival and the relative positions of said sensors; and a step of analyzing the determined function parameters for the different frequency values for which the quality measure is above a predetermined quality threshold, to identify a number of different groups of function parameters, each corresponding to a signal from a different source.

12. Computer executable instructions stored on a computer-readable memory medium for causing a programmable computing device to carry out a signal processing method comprising the steps of:

receiving a respective signal from three or more spaced sensors, each representing a signal generated from a source;

a first determining step of processing the received sensor signals to determine the relative times of arrival of the signal from said source at said three or more spaced sensors;

a second determining step of processing the determined relative times of arrival using a best fit analysis to determine a parameter of a function which models the shape of a wavefront of the signal generated by said source at said sensors and which relates said determined relative times of arrival to the relative positions of said sensors;

a third determining step of determining the direction in which said source is located relative to said sensors in dependence upon the determined function parameters;

a step of dividing each received signal into a plurality of time sequential segments;

a step of analyzing each segment of each received signal to determine a plurality of values representative of the frequency content of the signal in the segment at different frequencies, wherein said first determining step determines said relative times of arrival by comparing a current frequency value in a current time segment from a first one of said at least three sensors with a corresponding frequency value in a corresponding time segment from a second one of said at least three sensors;

a step of determining a measure of the quality of the fit between the predetermined function having the determined function parameter and the relative times of arrival and the relative positions of said sensors; and a step of analyzing the determined function parameters for the different frequency values for which the quality measure is above a predetermined quality threshold, to identify a number of different groups of function parameters, each corresponding to a signal from a different source.

* * * * *